US010607587B1

(12) United States Patent
Lord

(10) Patent No.: US 10,607,587 B1
(45) Date of Patent: Mar. 31, 2020

(54) ELECTRICAL HUM ELIMINATOR

(71) Applicant: John Lord, Calhoun, GA (US)

(72) Inventor: John Lord, Calhoun, GA (US)

( * ) Notice: Subject to any disclaimer, the term of this patent is extended or adjusted under 35 U.S.C. 154(b) by 23 days.

(21) Appl. No.: 16/014,405

(22) Filed: Jun. 21, 2018

(51) Int. Cl.
*G10H 3/18* (2006.01)
*G10H 1/32* (2006.01)
*G10D 1/08* (2006.01)

(52) U.S. Cl.
CPC ..... *G10H 3/181* (2013.01); *G10D 1/085* (2013.01); *G10H 1/32* (2013.01); *G10H 2220/505* (2013.01)

(58) Field of Classification Search
CPC ..... G10H 3/18
USPC ..... 84/728
See application file for complete search history.

(56) References Cited

U.S. PATENT DOCUMENTS 3,699,234 A * 10/1972 Adachi ..... G10H 5/005 84/687
3,704,339 A * 11/1972 Niinomi ..... G10H 1/02 84/687
3,705,948 A * 12/1972 Tomisawa ..... G10H 5/005 84/687
4,627,324 A * 12/1986 Zwosta ..... A63J 17/00 84/464 R
5,125,313 A * 6/1992 Hiyoshi ..... G10H 1/0558 84/600
5,147,969 A * 9/1992 Hiyoshi ..... G10H 1/0558 84/600
7,084,341 B2 * 8/2006 Barr ..... G10H 1/32 84/279
7,569,762 B2 * 8/2009 Baum, Jr. ..... G10H 1/0083 84/615
9,947,307 B2 * 4/2018 Takasaki ..... G10D 13/024
2004/0159225 A1 * 8/2004 Barr ..... G10H 1/32 84/743
2005/0034590 A1 * 2/2005 Querfurth ..... G10H 1/0066 84/645
2007/0175321 A1 * 8/2007 Baum ..... G10H 1/0083 84/737

(Continued)

OTHER PUBLICATIONS https://www.prosoundweb.com/topics/studio/eliminating_troublesom_hum_buzz_created_by_electric_guitars/ Jan. 16, 2017; Viewed online on Aug. 28, 2018.*

(Continued)

*Primary Examiner* — David S Warren
(74) *Attorney, Agent, or Firm* — Ference & Associates LLC

(57) ABSTRACT

A noise eliminator to eliminate electrical hum from an amplified musical instrument is provided. An aspect provides a method of playing an electrically amplified musical instrument having a sound pickup system that is electrically grounded, including, but not limited to, the steps of: disposing a first connector to the skin of a player of the amplified musical instrument, wherein the connector has least two oppositely disposed sides, and wherein the first disposed side removably adheres to the skin of the player and the second disposed side permits an electrical connection to be made with the player's skin; disposing a second connector that is electrically connected to the electrical ground of the sound pickup system; and establishing an electrical connection between the first connector and the second connector. Other aspects are described and claimed.

11 Claims, 4 Drawing Sheets

(56) References Cited

U.S. PATENT DOCUMENTS

| | | | | |
|---|---|---|---|---|
| 2007/0175322 | A1* | 8/2007 | Baum, Jr. | G10H 1/0083 84/737 |
| 2007/0182545 | A1* | 8/2007 | Baum | G10H 1/0083 340/539.11 |
| 2014/0202319 | A1* | 7/2014 | Osborne | G10H 3/181 84/728 |
| 2017/0236505 | A1* | 8/2017 | Takasaki | G10D 13/024 84/723 |
| 2018/0197517 | A1* | 7/2018 | Takasaki | G10D 13/024 |

OTHER PUBLICATIONS https://www.seymourduncan.com/forum/showthread.php?312200-Using-ring-terminals-for-grounding. 2016. Viewed online on Jul. 4-7, 2019.*

* cited by examiner

ELECTRICAL HUM ELIMINATOR

BACKGROUND

Technical Field

The invention herein generally relates to electrical hum eliminators, and more particularly to electrical hum eliminators for amplified musical instruments.

Description of the Related Art

Amplified musical instruments such as guitars rely upon sensors embedded in the guitar to pick up the sound generated by the vibration of the strings converting that sound into a signal that is then transmitted and amplified through an amplifier. However, noise (hum) may be caused by the cycles of electrical current that power the amplifier.

Accordingly, there is a need for a simple, economical and portable noise eliminator to eliminate the hum in amplified musical instruments.

SUMMARY

In view of forgoing, an embodiment herein provides a method of playing an electrically amplified musical instrument having a sound pickup system that is electrically grounded, comprising: disposing a first connector to the skin of a player of the amplified musical instrument, wherein the connector has least two oppositely disposed sides, and wherein the first disposed side removably adheres to the skin of the player and the second disposed side permits an electrical connection to be made with the player's skin; disposing a second connector that is electrically connected to the electrical ground of the sound pickup system; and establishing an electrical connection between the first connector and the second connector.

Another embodiment provides a combination of an electrically amplified string instrument and a player grounding system, wherein the string instrument has a sound pickup system that is electrically grounded and wherein the player grounding system comprises: a first connector that attaches to the skin of a player, wherein the connector has least two oppositely disposed sides, and wherein the first disposed side removably adheres to the skin of the player and the second disposed side permits an electrical connection to be made with the player's skin; a second connector that is electrically connected to the electrical ground of the sound pickup system; and an electrical connection between the first connector and the second connector.

A further embodiment provides a kit for an electrically amplified string instrument, comprising: a first connector that attaches to the skin of a player, wherein the connector has least two oppositely disposed sides, and wherein the first disposed side removably adheres to the skin of the player and the second disposed side permits an electrical connection to be made with the player's skin; a second connector that is electrically connected to the electrical ground of the sound pickup system; and an electrical connection between the first connector and the second connector.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

Figure 1:
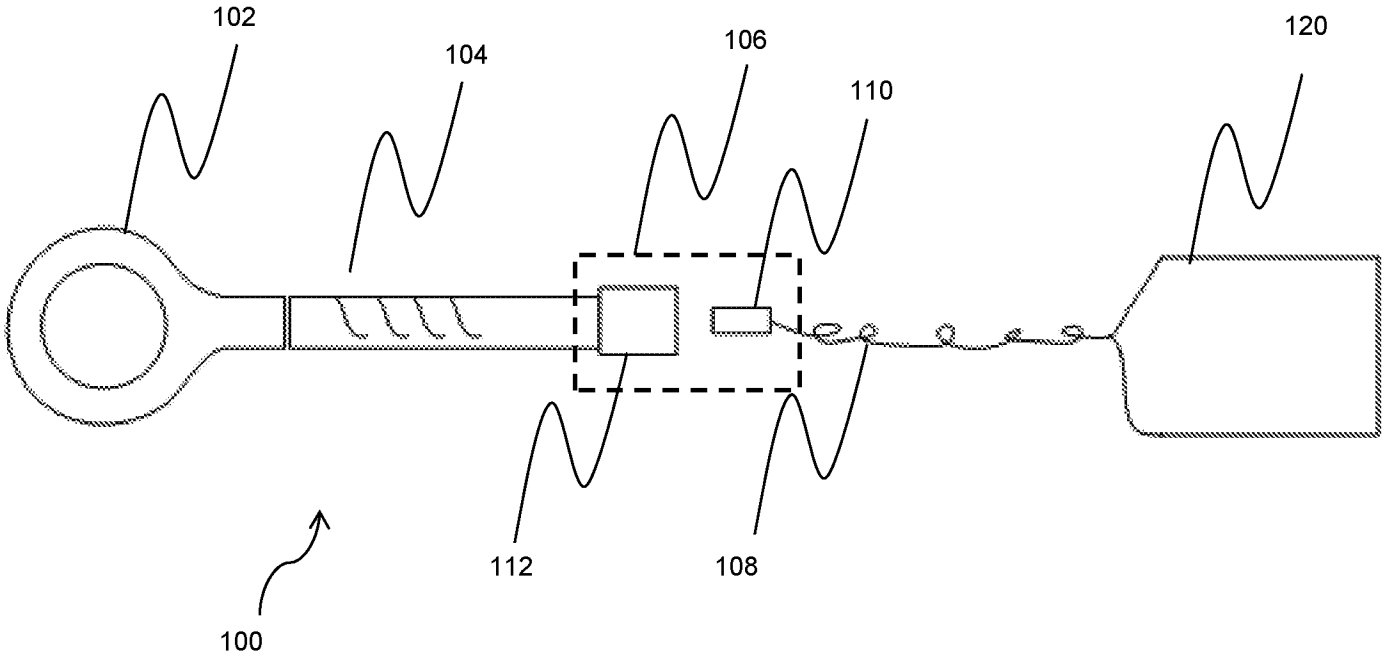
FIG. 1 is an example system for a noise eliminator to eliminate electrical hum in amplified instruments.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

When playing an amplified musical instrument such as an electrical guitar, the cycling of the alternating current electrical power source needed to drive the amplifier may result in unwanted noise from the amplifier. This noise results from the cycling of the alternating current used to power the amplifier. The cycling (or power line frequency) is at 60 Hertz (60 cycles for second) in the U.S. and 50 Hertz (50 cycles for second) outside the U.S. This noise heard through an amplifier or on recordings and recording equipment is referred to as main line hum, electrical hum or power line hum (hereinafter "hum") among musicians and recording professionals.

The inventor has discovered that by placing an eyelet underneath the volume knob or other metal portion of an amplified musical instrument and connecting that eyelet to one or more wires and connectors to an adhesive pad placed on the musical instrument player's skin, the hum is eliminated. Thus, by grounding the musical instrument, the hum caused by the alternating current electricity is eliminated. The inventor's inexpensive solution for grounding a musical instrument may be practiced with any amplified musical instrument and may be accomplished through various styles, gauges, lengths of wires, and various connections, connectors and adhesive pads and combinations of these elements. It is equally applicable for eliminating any frequency of electrical hum (i.e., 50 Hertz, 60 Hertz, and the like).

Referring now to the drawings, and more particularly to FIGS. 1 through 4, where similar reference characters denote corresponding features consistently throughout the figures, there are shown preferred embodiments.

FIG. 1 illustrates an example noise eliminator to eliminate electrical hum in amplified instruments according to an embodiment herein. The noise eliminator 100 includes an eyelet 102, a sticky pad 120, a connection 106 (shown in dashed lines), and a wire 108. The eyelet 102 may be connected to any metal piece of the amplified musical instrument. In one non-limiting example show in FIG. 4, the eyelet 102 may be placed underneath a volume knob of a guitar 400. The sticky pad 120 is connected to the eyelet 102 through various wires and connections and is attached to the skin of a user (not shown in FIGS).

Returning to FIG. 1, the connection 106 may be adapted to connect the eyelet 102 and a short wire 104 to sticky pad 120 by wire 108. It will be appreciated that the wire 108 may consist of any convenient thickness (gauge) and may be comprised of any metal insulated by any appropriate method including plastic or cord or other wires. Further wire 108 may be of any convenient length to avoid restriction of movement while the wire 108 is connected at connection 106.

The eyelet 102 collects the hum-producing electrical signal caused by the electricity driving the amplifier connected to the amplified musical instrument and sends the noise signal through the wires and connectors to the sticky pad 120. The sticky pad 120 (which comprises one or more wires) once adhered to the user's skin then grounds the noisy electrical signal collected by the eyelet 102. The sticky pad 120 may be placed on the user's skin and under the user's belt to prevent the pad from coming loose while playing the musical instrument.

In this non-limiting example, the connection 106 comprises a male connector 110 and a female connector 112. The male connector 110 is connected to the wire 108 and then connected to the sticky pad 120. The female connector 112 is connected to the short wire 104 which is connected to the eyelet 102. By inserting the male connector 110 into the female connector 112 the noise collected at eyelet 102 is able to conduct through the system 100 and ground out through the sticky pad 120 adhered to the user's skin. It should be appreciated that many other configurations for connection 106 are equally applicable for connecting the musical instrument to the conducting wire to the user's skin and these configurations are contemplated in the various embodiments described herein.

Figure 2:
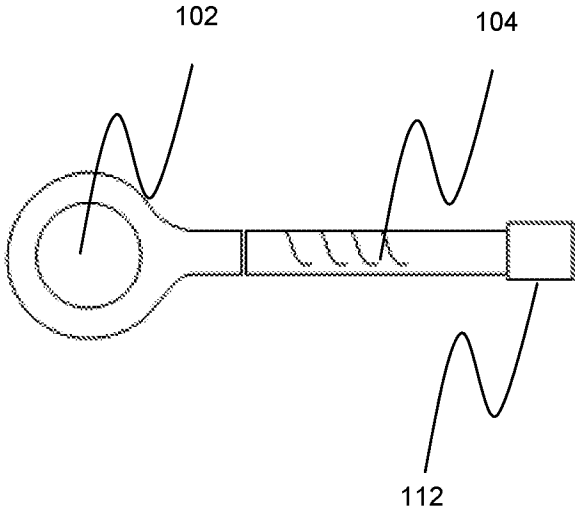
FIG. 2 illustrates an exploded view of the eyelet of FIG. 1 according to an embodiment herein.

FIG. 2 illustrates an exploded view of the eyelet 102 of FIG. 1 according to an embodiment herein. In an embodiment, the eyelet 102 may include a short wire 104. Short wire 104 is connected to a female connector 112. In another embodiment, for convenience the eyelet 102 may be connected underneath a volume knob of the amplified musical instrument with the short wire 104 and the female connector 112 may be permitted to remain attached to the musical instrument by simply disconnecting the male connector 110. It should be apparent that any connector sufficient to hold wire 104 to a metal portion of the amplified musical instrument (e.g., alligator clip, electrical clip, wire connector, and the like) may be used.

Figure 3:
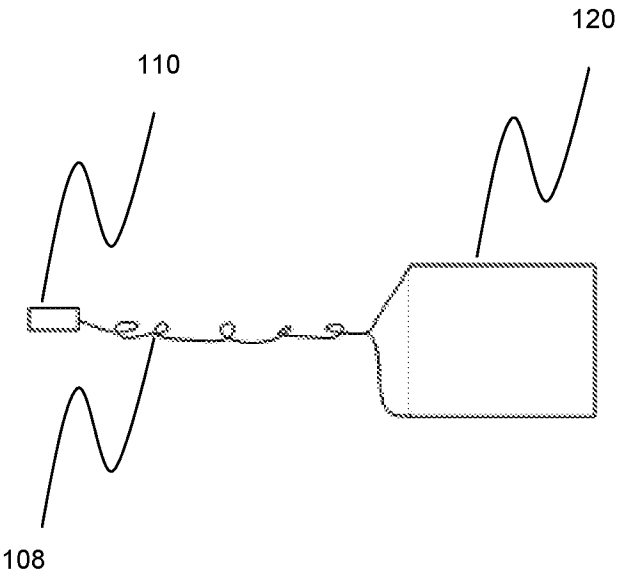
FIG. 3 illustrates an exploded view of the sticky pad of FIG. 1 according to an embodiment herein.

FIG. 3 illustrates an exploded view of the sticky pad end of noise eliminator 100, namely connector 110, wire 108, and sticky pad 120. In an embodiment, the wire 108 may be a 19-gauge coiled copper wire, or a connection cable. In another embodiment, the male connector 110 may be adapted to be inserted into the female connector 112 (as shown in FIG. 1 and FIG. 2). It will be appreciated that any appropriate sticky pad used to conduct electrical signals to and from skin for medical testing may be used. Non-limiting examples of such sticky pads include pads used for conducting electromyography, electrocardiogram, and nerve conduction and velocity test studies. Likewise, adhesive pads used for transcutaneous electrical nerve stimulation might also be utilized for sticky pad 120.

Figure 4:
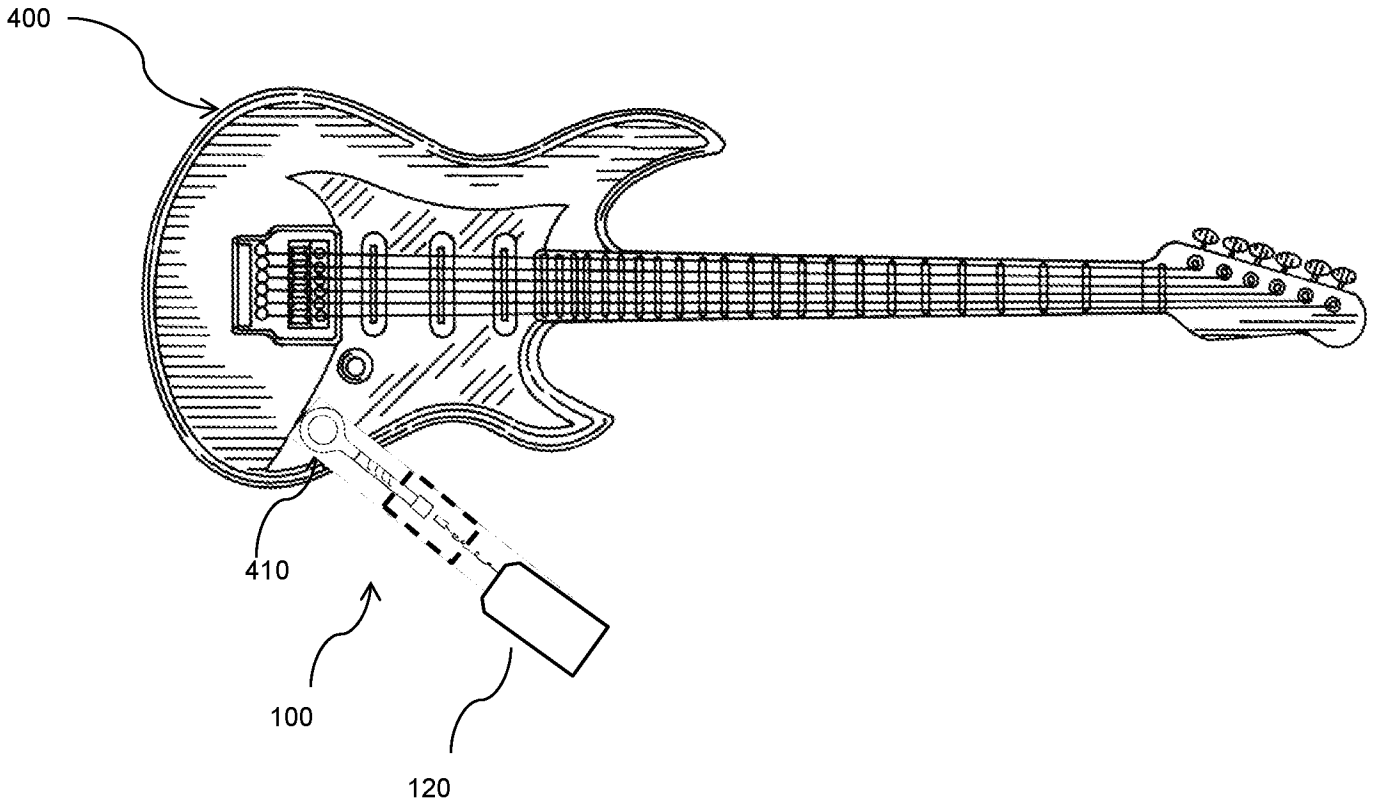
FIG. 4 illustrates a perspective view of an example embodiment.

FIG. 4 illustrates a perspective view of an example embodiment. Noise eliminator 100 may be attached to Guitar 400 by placing eyelet 102 underneath of the volume knob 410. To ground the Guitar 400, the user may adhere the sticky pad 120 to the user's skin.

It will be appreciated by those skilled in the art that the noise eliminator 100 may be used to eliminate electrical hum from any amplified musical instrument, including but not limited to, electric guitars, electrical basses, acoustic electric guitars, electrical violins, and electrical drums.

An example embodiment provides a method of playing an electrically amplified musical instrument having a sound pickup system that is electrically grounded, comprising: disposing a first connector to the skin of a player of the amplified musical instrument, wherein the connector has least two oppositely disposed sides, and wherein the first disposed side removably adheres to the skin of the player and the second disposed side permits an electrical connection to be made with the player's skin; disposing a second connector that is electrically connected to the electrical ground of the sound pickup system; and establishing an electrical connection between the first connector and the second connector.

Another example embodiment provides a combination of an electrically amplified string instrument and a player grounding system, wherein the string instrument has a sound pickup system that is electrically grounded and wherein the player grounding system comprises: a first connector that attaches to the skin of a player, wherein the connector has least two oppositely disposed sides, and wherein the first disposed side removably adheres to the skin of the player and the second disposed side permits an electrical connection to be made with the player's skin; a second connector that is electrically connected to the electrical ground of the sound pickup system; and an electrical connection between the first connector and the second connector.

A further example embodiment provides a kit for an electrically amplified string instrument, comprising: a first connector that attaches to the skin of a player, wherein the connector has least two oppositely disposed sides, and wherein the first disposed side removably adheres to the skin of the player and the second disposed side permits an electrical connection to be made with the player's skin; a second connector that is electrically connected to the electrical ground of the sound pickup system; and an electrical connection between the first connector and the second connector.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A method of playing an electrically amplified musical instrument having a sound pickup system that is electrically grounded, comprising:

disposing a first connector to the skin of a player of the electrically amplified musical instrument, wherein the first connector is a sticky pad that removably adheres to the skin of the player and permits an electrical connection to be made with the player's skin;

disposing a second connector that is electrically connected to a volume knob of the electrically amplified musical instrument, wherein the second connector is an eyelet;

wherein the eyelet is connected to a short wire and the short wire is connected to a female connector;

wherein the sticky pad is connected to a wire that is connected to a male connector;

wherein the wire is a 19-Gauge coiled copper wire;

establishing an electrical connection between the first connector and the second connector by inserting the male connector into the female connector; and playing the electrically amplified musical instrument through an amplifier.

2. The method of claim 1, wherein the amplified musical instrument is an acoustic guitar with electrical pickups.

3. The method of claim 1, wherein the amplified musical instrument is a bass guitar.

4. A combination of an electrically amplified string instrument and a player grounding system, wherein the string instrument has a sound pickup system that is electrically grounded and wherein the player grounding system comprises:

a first connector that attaches to the skin of a player, wherein the first connector is a sticky pad that removably adheres to the skin of the player and permits an electrical connection to be made with the player's skin;

a second connector that is electrically connected to a grounded portion of the electrically amplified musical instrument, wherein the second connector is an eyelet;

wherein the eyelet is connected to a short wire and the short wire is connected to a female connector;

wherein the sticky pad is connected to a wire that is connected to a male connector;

wherein the wire is a 19-Gauge coiled copper wire;

an electrical connection that is established between the first connector and the second connector by inserting the male connector into the female connector.

5. The combination of claim 4, wherein the amplified musical instrument is a guitar.

6. The combination of claim 5, wherein the guitar is an acoustic guitar with electrical pickups.

7. The combination of claim 5, wherein the guitar is a bass guitar.

8. A kit for an electrically amplified string instrument having a sound pickup system that is electrically grounded, comprising:

a first connector that attaches to the skin of a player, wherein the first connector is a sticky pad that removably adheres to the skin of the player and permits an electrical connection to be made with the player's skin;

a second connector that is electrically connected to the electrically amplified musical instrument, wherein the second connector is an eyelet;

wherein the eyelet is connected to a short wire and the short wire is connected to a female connector;

wherein the sticky pad is connected to a wire that is connected to a male connector;

wherein the wire is a 19-Gauge coiled copper wire; and an electrical connection is established between the first connector and the second connector by inserting the male connector into the female connector.

9. The method of claim 1, wherein a second connection is made that connects the eyelet and short wire to the sticky pad by the wire and wherein the second connection comprises a female plug and a male plug.

10. The combination of claim 4, wherein a second connection is made that connects the eyelet and short wire to the sticky pad by the wire and wherein the second connection comprises a female plug and a male plug.

11. The kit of claim 8, wherein a second connection is made that connects the eyelet and short wire to the sticky pad by the wire and wherein the second connection comprises a female plug and a male plug.

* * * * *